US007185796B2

(12) United States Patent
Parsons

(10) Patent No.: US 7,185,796 B2
(45) Date of Patent: Mar. 6, 2007

(54) BATON SCABBARD WITH ROLLER CLAMP RETENTION

(75) Inventor: Kevin L. Parsons, Appleton, WI (US)

(73) Assignee: Armament Systems & Procedures, Inc., Appleton, WI (US)

( * ) Notice: Subject to any disclaimer, the term of this patent is extended or adjusted under 35 U.S.C. 154(b) by 401 days.

(21) Appl. No.: 10/680,994

(22) Filed: Oct. 8, 2003

(65) Prior Publication Data

US 2005/0077332 A1 Apr. 14, 2005

(51) Int. Cl.
*A01K 97/04* (2006.01)

(52) U.S. Cl. ..... 224/197; 248/113

(58) Field of Classification Search ..... 224/197; 24/338, 339; 248/113
See application file for complete search history.

(56) References Cited

U.S. PATENT DOCUMENTS 1,117,491 A * 11/1914 Hornung ..... 211/63
1,174,185 A * 3/1916 Scott ..... 211/68
1,666,045 A * 4/1928 Ganny et al. ..... 248/113
1,798,028 A * 3/1931 Nachtigal ..... 248/113
1,911,781 A * 5/1933 Wolfe, Jr. ..... 248/113
2,379,060 A * 6/1945 Bacheldor ..... 248/113
3,603,550 A * 9/1971 Byrd ..... 248/313
4,705,177 A * 11/1987 Oren ..... 211/70.5
4,848,714 A * 7/1989 Ziaylek, Jr. et al. ..... 248/313
4,953,769 A 9/1990 Parsons et al.
4,955,518 A 9/1990 Parsons et al.
5,217,151 A 6/1993 Parsons
5,449,104 A 9/1995 Parsons et al.
5,590,567 A 1/1997 Marrs et al.
5,617,980 A 4/1997 Parsons et al.
5,772,089 A 6/1998 Parsons et al.
5,947,352 A 9/1999 Parsons
5,992,811 A * 11/1999 McFerren et al. ..... 248/316.3
6,059,157 A 5/2000 Parsons et al.

OTHER PUBLICATIONS http://home.att.net/~dwight-watt/stained/letter-C.html.*
http://senseis.xmp.net/?SecondaryLibertiesExampleC.*

* cited by examiner

*Primary Examiner*—Tri M. Mai
(74) *Attorney, Agent, or Firm*—Welsh & Katz, Ltd.

(57) ABSTRACT

A baton scabbard for stowing various length batons enables insertion into and removal of a baton from the scabbard through lateral movement of the baton. The scabbard includes a generally C-shaped housing that supports a pair of laterally spaced snap-action latching mechanisms mutually cooperable in response to entry of a baton to effect a snap-action retention of the baton within the housing. A belt or strap attachment is pivotally connected to the housing for attaching the scabbard to a user's belt and permits the housing and a baton held therein to be selectively oriented relative to the user irrespective of the length of the baton.

11 Claims, 7 Drawing Sheets

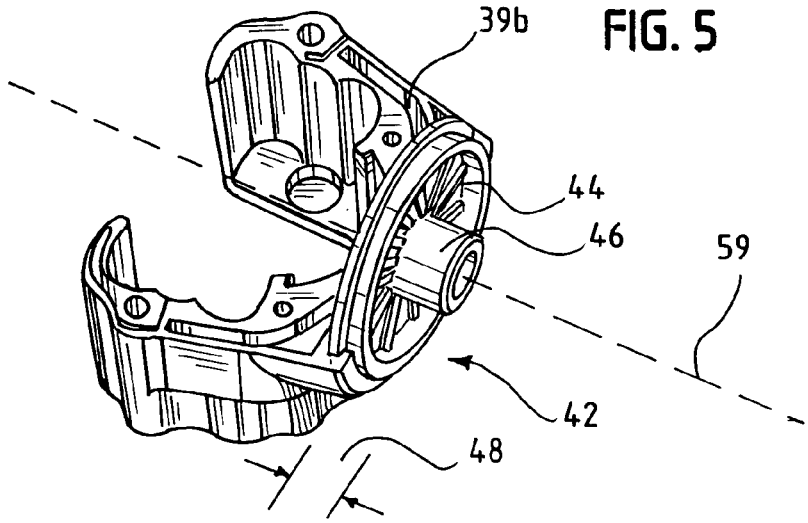
FIG. 5
FIG. 6
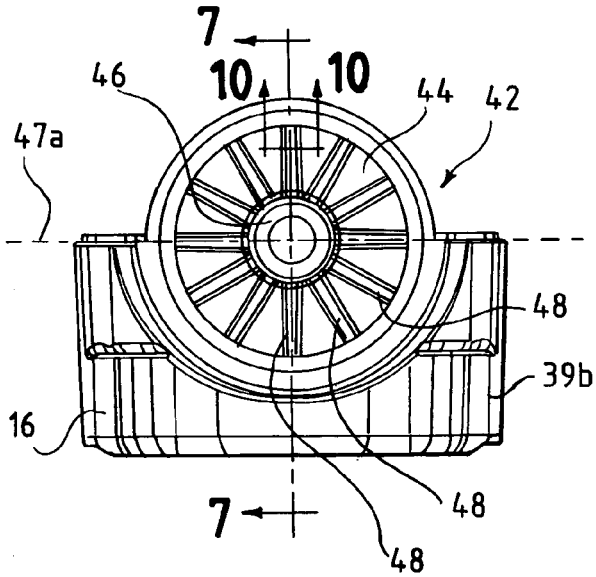
FIG. 7
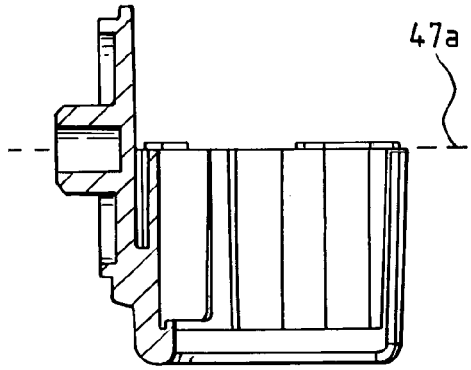
FIG. 8
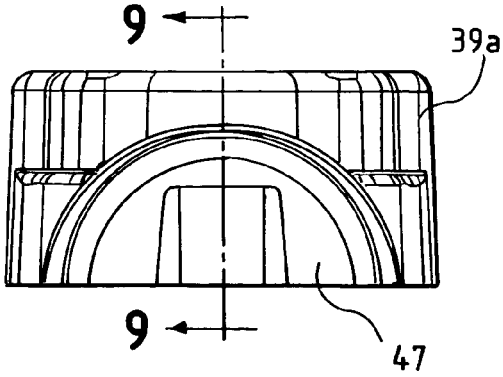
FIG. 9
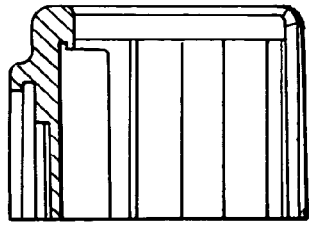

BATON SCABBARD WITH ROLLER CLAMP RETENTION

FIELD OF THE INVENTION

The present invention relates generally to baton carriers or scabbards for releasably supporting expandable batons, generally at the waist level of a user. More particularly, the present invention relates to a scabbard for releasably supporting a fixed length or expandable baton, in either a retracted or extended position, at the waist level of a user such that the baton may be readily inserted into and released from the scabbard by lateral movement of the baton relative to the scabbard, and may be angularly oriented relative to the user's torso to enable selective positioning of the baton for access, and to enable the user to comfortably stand, squat, or sit without having to further manipulate the scabbard or baton.

BACKGROUND OF THE INVENTION

Batons are well known as intermediate force weapons that provide a tactical, yet generally non-lethal means for use by law enforcement and security personnel to maintain order. When not in use, batons may be stowed in a variety of different types of carriers or holsters, typically termed scabbards, which are adapted for mounting on a belt or strap disposed about the waist of the user. Modem batons are typically lightweight and include expandable high strength telescoping tubular sections that when retracted into a handle can be conveniently carried in a belt supported scabbard for convenient access by the user. Known baton scabbards for supporting an expandable baton on the user's belt or on a separate strap disposed about the user's waist generally do not permit the baton to remain in a comfortable orientation on the waist when the officer is seated. Further, baton scabbards are known that enable a baton to be released from the scabbard by lateral movement of the baton relative to the scabbards, but generally do not permit a baton to be readily inserted into the scabbard through movement of the baton in a lateral direction relative to the scabbard.

Generally, security baton scabbards are designed so that a stowed baton cannot be inadvertently released from the scabbard or be readily seized from the scabbard by an adversary. Prior baton sheaths are operative to positively secure the baton within the scabbard, while at the same time providing for relatively quick release of the baton for authorized use. When an expandable baton is fully extended, it is usually releasably retained in the extended position and can be retracted by sharply striking the extended end of the baton with an axial blow. Batons come in various lengths, and a baton scabbard should preferably be capable of positively retaining or stowing batons of various lengths having a fixed diameter.

Known baton carriers or scabbards are generally designed to stow an expandable type baton when fully retracted and inserted into the scabbard. When stowed in the scabbard, the longitudinal axis of the retracted baton is generally disposed in a vertical orientation substantially perpendicular to the waistline of the user and parallel to the user's leg when the user is standing. The baton axis is generally disposed at approximately a 90 degree angle to the user's leg when the user is seated. A stowed retracted baton generally permits unrestricted movement by the wearer. However, in certain applications, such as when a subject is not fully under control, and the like, it may be preferred or occasionally necessary to at least temporarily stow the baton in its expanded or extended position. Also, on occasion it may be impractical to collapse the baton, particularly where a hard surface is not available for striking the outermost end of the extended sections with an axial blow, such as when the user is on a soft grassy area. Under these circumstances, a scabbard that enables a baton to be readily inserted and withdrawn from the scabbard through lateral movement of the baton when in either an expanded or retracted condition would significantly enhance the utility of the scabbard.

While baton scabbards are generally used to stow a baton, occasions arise when it is convenient for a law enforcement or security office to use a scabbard to support other security devices useful in assisting the officer in fulfilling his or her duties. For example, it is sometimes necessary for law enforcement and security officers to use a baton-flashlight combination, such as the ASP TRIAD® flashlight manufactured by Armament Systems and Procedures, Inc., which generally have cylindrical handles or battery receiving barrels. Such combination baton-flashlights are generally held in one hand while an officer investigates a darkened area, and the barrel of the flashlight is generally disposed either parallel to the ground surface or at an angle no greater than approximately 45 degrees below or above horizontal. A scabbard capable of releasably supporting a combination baton-flashlight at various angles and that enables attachment to and release from the scabbard by lateral movement relative to the scabbard, would leave both hands of the user free for other tasks.

SUMMARY OF THE INVENTION

In accordance with the present invention, a baton scabbard and associated belt or strap attachment clip are provided that permit the scabbard to be worn on the user's waist and enable a baton to be readily inserted into and released from the scabbard through lateral movement of the baton relative to the scabbard. The baton can be stowed in either an expanded (open) or closed configuration, and the belt clip permits the baton, in either its expanded or closed configuration, to be oriented for maximum comfort and accessibility while the wearer is standing, seated or disposed in any other position.

In a preferred embodiment, the scabbard includes a generally C-shaped housing that defines a C-shaped recess and supports at least one over-center snap-action latching mechanism, and preferably a pair of mutually cooperable latching mechanisms, such that a baton may be snapped into and released from the scabbard by lateral movement of the baton relative to the recess, and held in place against a stop surface in the form of a back wall of the recess or a rear friction pad by the latching mechanisms. The generally C-shaped recess is open at its top and bottom such that a baton of substantially any length can be readily stowed in the scabbard.

The scabbard preferably includes a pair of laterally opposed snap-action latching mechanisms, each of which includes parallel front and rear crowned rollers rotatably supported in a yoke assembly for snap-action pivotal movement. The yoke assemblies are supported by the housing on laterally opposite sides of the C-shaped recess and are pivotal about parallel pivot axes such that the front and rear rollers are laterally spaced as pairs of parallel front and rear rollers, respectively. The corresponding pairs of front and rear rollers are positioned to enable a baton to be inserted laterally between the two front rollers and urged against the rear pair of laterally spaced rollers so that the rollers and yoke assemblies undergo a snap-action pivotal movement about their respective pivot axes as the baton progressively enters the scabbard. In this manner, the laterally opposed rollers undergo a snap-action engagement with the baton so that the baton is gripped between the laterally opposed front and rear pairs of rollers and urged against the recess back wall or friction pad to thereby releasably retain the baton in place within the scabbard until withdrawn in a reverse direction.

The scabbard belt or strap attachment clip is pivotally connected to the scabbard C-shaped housing so as to enable the housing and a stowed baton to be attached to a belt or strap disposed about the user's waist and selectively angularly oriented relative to the belt or strap. A user can thus orient a baton or other elongated device stowed in the scabbard to better facilitate comfortable sitting, stooping or standing by the user. This leaves the user's hands free for other tasks.

Further objects, features and advantages of the present invention will become apparent from the following detailed description of a preferred embodiment when taken in conjunction with the accompanying drawings wherein like reference numerals designate like elements throughout the several views.

BRIEF DESCRIPTION OF THE DRAWINGS

FIG. 5 is a perspective view of the bottom case housing of the scabbard of FIG. 1 with the belt clip removed to illustrate a circular array of the detents formed on the bottom case housing;

FIG. 6 is a rear elevational view of the bottom case housing of FIGS. 2 and 5;

FIG. 7 is a sectional view of the bottom case housing of FIG. 5 taken along the line 7—7 of FIG. 6;

FIG. 8 is a rear elevational view of the top case housing of FIG. 2;

FIG. 9 is a sectional view of the top case housing of FIG. 8 taken along the line 9—9 of FIG. 8;

DETAILED DESCRIPTION

Figure 1:
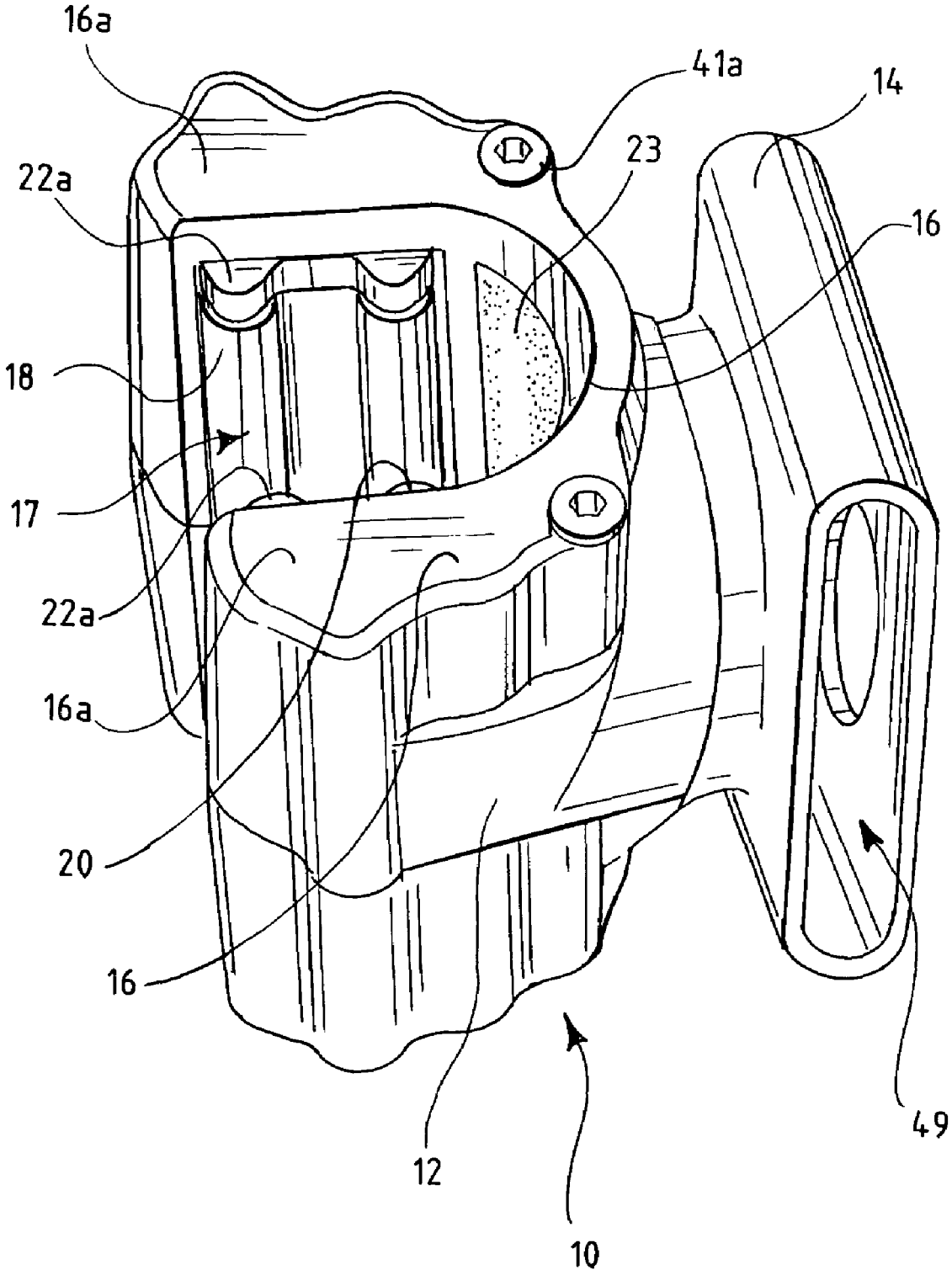
FIG. 1 is a perspective view of a baton scabbard constructed in accordance with a preferred embodiment of the present invention.

While the present invention is susceptible of embodiments in various forms, there is shown in the drawings a presently preferred embodiment that is described in greater detail hereafter. It should be understood that the present disclosure is to be considered as an exemplification of the present invention, and is not intended to limit the invention to the specific embodiment illustrated and described. It should be further understood that the title of this section of this application ("Detailed Description") relates to a requirement of the United States Patent and Trademark Office, and should not be found to limit the subject matter disclosed herein.

Figure 2:
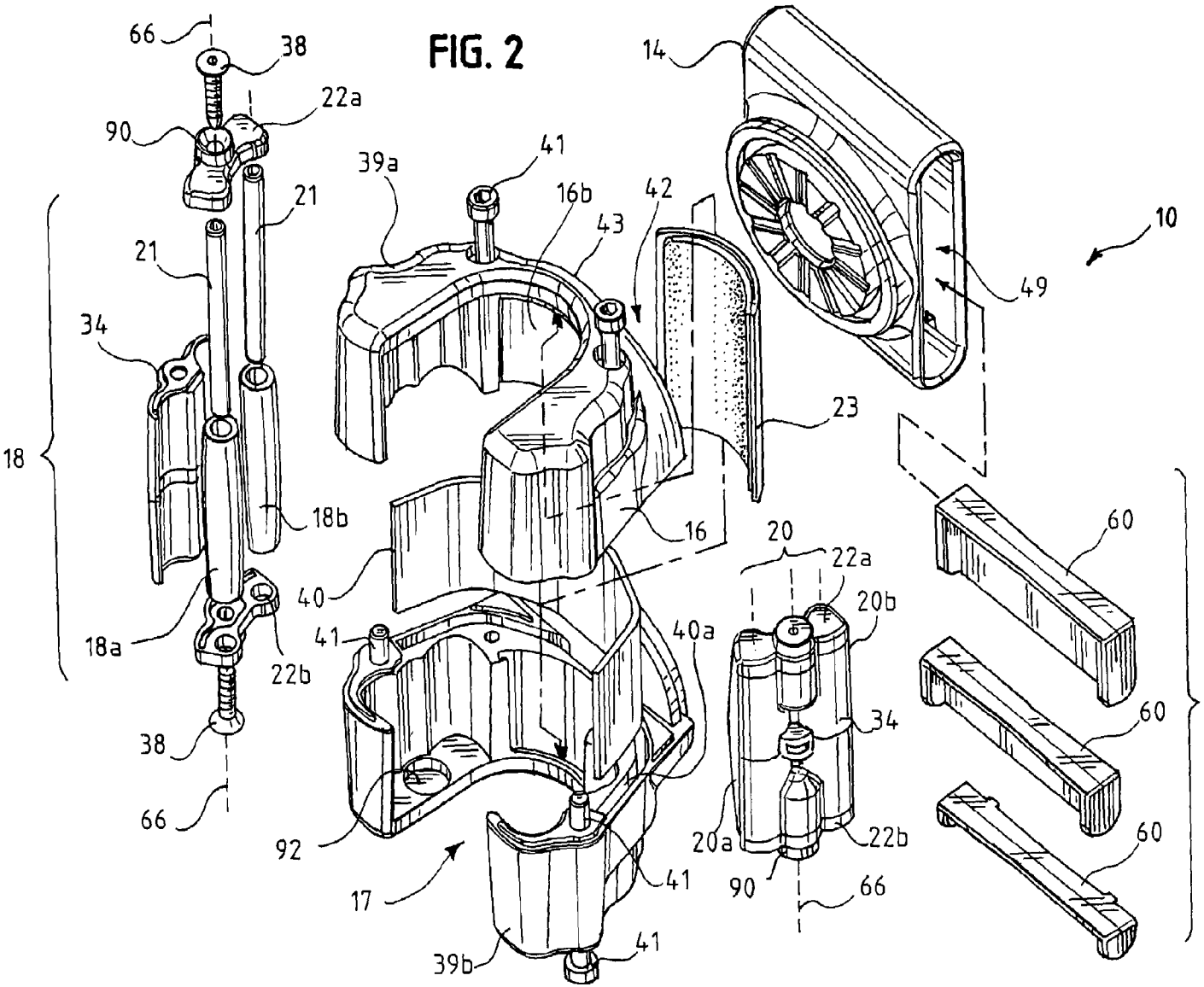
FIG. 2 is an exploded perspective view of the baton scabbard of FIG. 1.
Figure 3:
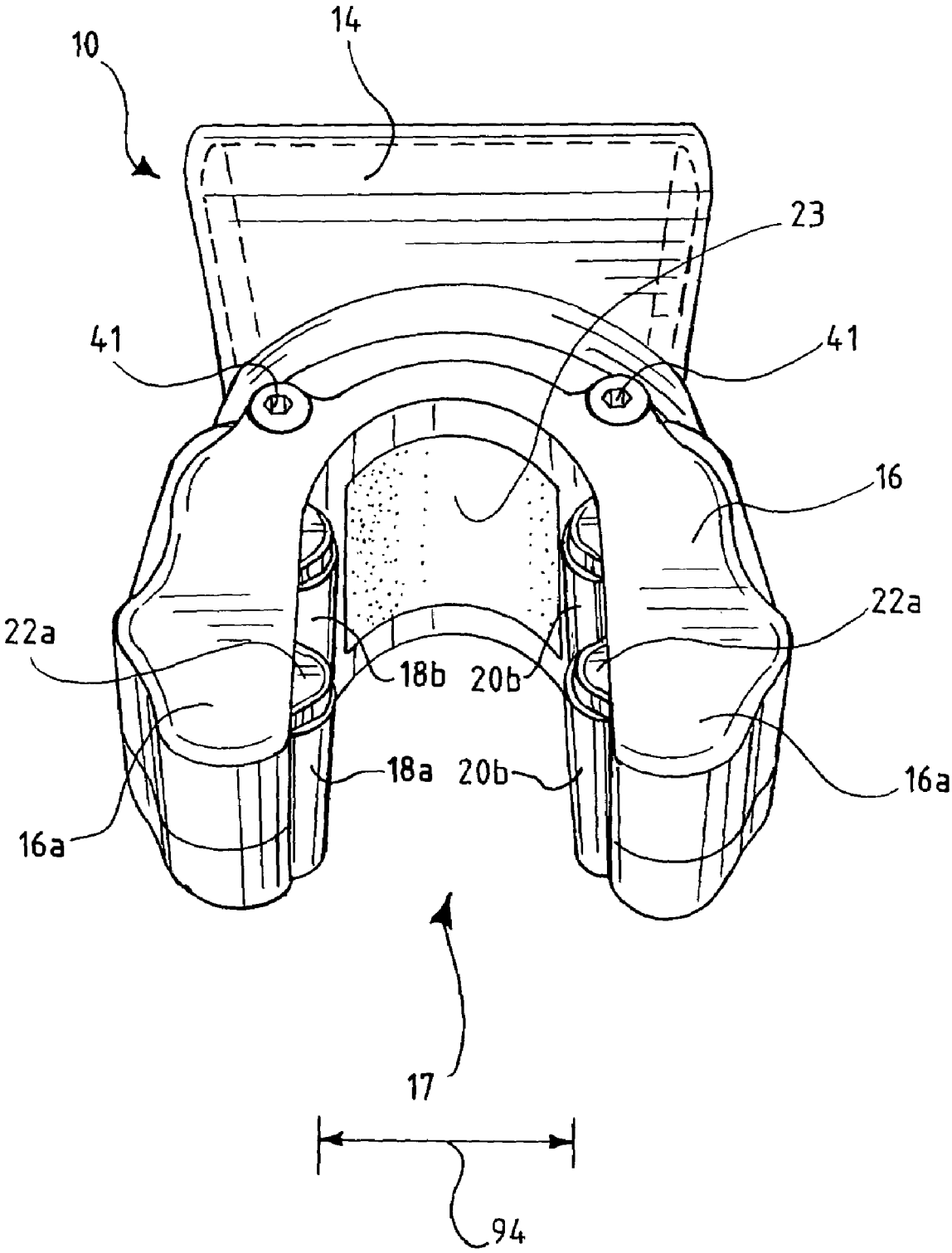
FIG. 3 is a perspective view of the baton scabbard of FIG. 1 with portions thereof showing a sectional view.

Referring now to the drawings, and in particular to FIGS. 1–3, a baton scabbard constructed in accordance with a preferred embodiment of the present invention is indicated generally at 10. The scabbard 10 includes a baton holder 12 and a belt or strap attachment clip assembly 14 that enables the scabbard to be supported on a user's belt or a strap disposed about the user's waist. The baton holder 12 includes a generally C-shaped housing 16 having curved "arms" 16*a*, that are substantially mirror images of each other. The arms 16*a* are preferably integrally formed with or otherwise suitably secured to an interior connecting wall 16*b* and define a generally C-shaped recess therebetween having a baton receiving entry opening 17. The C-shaped housing 16 pivotally supports over-center snap-action mechanism means in the form of at least one, and preferably two roller assemblies 18 and 20. Each roller assembly 18 and 20 includes a pair of forward rollers 18*a*, 20*a* and rear rollers 18*b*, 20*b*, respectively, that are each rotatably supported in predetermined parallel relation to each other by pins 21, the opposite ends of which are secured to and between corresponding upper and lower pairs of parallel roller assembly caps 22*a* and 22*b*, as best illustrated in FIG. 2.

Figure 4:
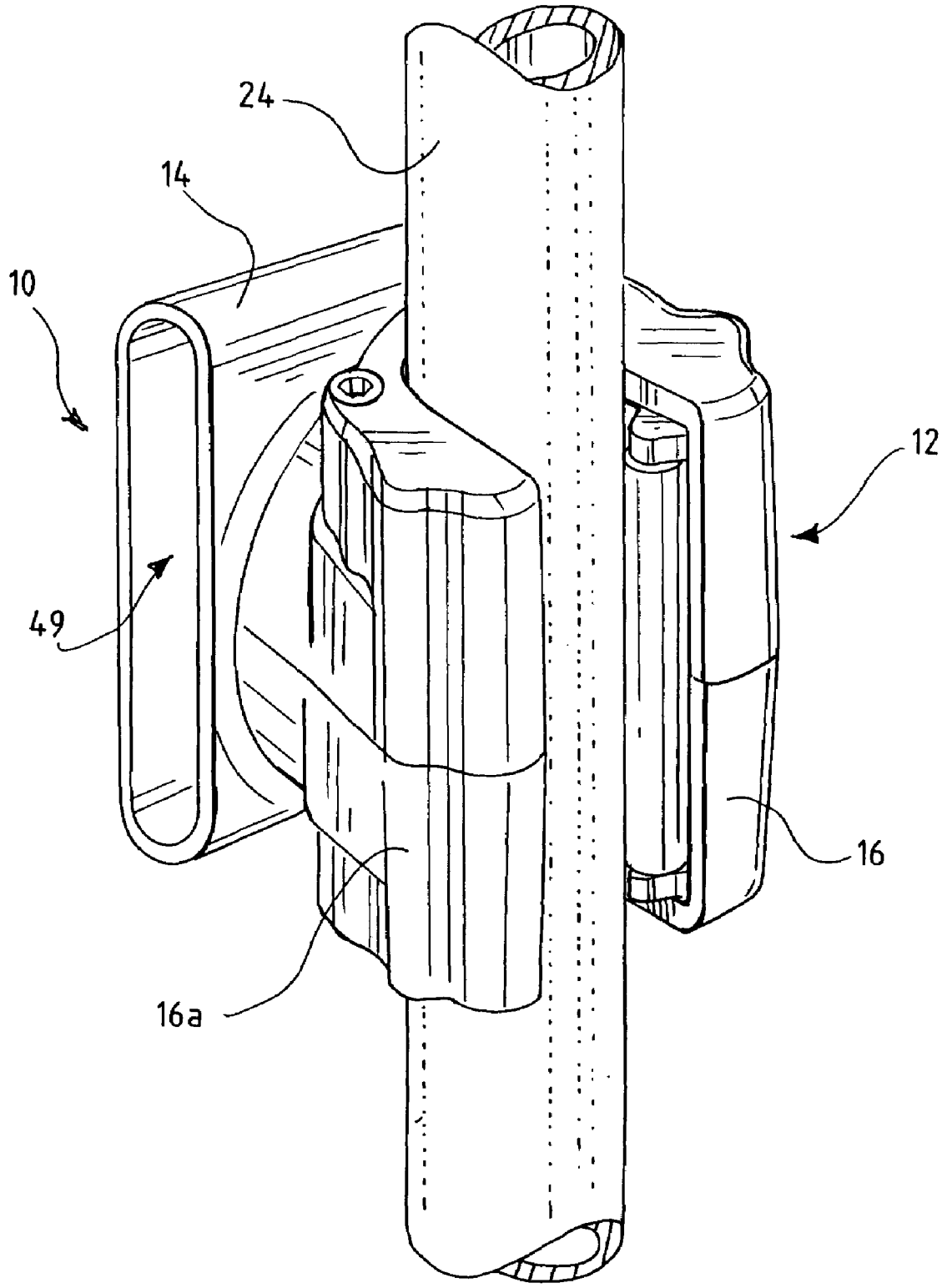
FIG. 4 is a perspective view of the baton scabbard of FIG. 1 having a fragmentary portion of a baton inserted therein.

The housing 16 is shown having a friction pad 23 in its interior wall 16*b*. Friction pad 23 may be, for example, a flexible sheet or insert providing a contact surface that a baton 24 (FIG. 4) contacts upon placement in the scabbard 10. Note that such batons and others, for example, are disclosed in U.S. Pat. Nos. 5,348,297, 5,356,139, 5,407,197, 5,509,653, 5,657,986, 5,667,441 and 5,868,621, which are all assigned to the assignee of the present application. The friction pad 23 permits the placement of the baton 24 in the scabbard 10 in such a manner as to keep the baton 24 from slipping while placed in the scabbard 10. In a preferred embodiment of the present invention, a baton having a rubberized, or otherwise cushioned grip is used, and the friction pad 23 is made of a rubber material having a smooth surface. It has been found that a smooth surface rubber material will provide a superior means of holding the baton 24 with a cushioned grip, within the scabbard 10. The smooth material of friction pad 23 and cushioned grip of the baton 24 provide a desirable degree of frictional contact with each other. It will be understood by persons having skill in the art that the scabbard 10 can be constructed without the friction pad 23 or with a friction pad using a different type of material (having either a greater or lower coefficient of friction) than in the described embodiments, without departing from the novel scope of the present invention. Further, in a preferred embodiment of the present invention, the friction pad 23 can be removeably placed within the scabbard 10 such that it can be easily removed and replaced by another type of friction pad that may be more suitable to a different type of baton. Alternatively, the friction pad 23 may be fully removed.

Referring now to FIG. 2, the elements of the baton holder 12 and belt attachment 14 can be seen in greater detail. It can be seen that roller assemblies 18 and 20 are similar in construction, and each comprises the front rollers 18*a*, 20*a* and the rear rollers 18*b*, 20*b*, which prefereably have crowned external peripheral surfaces aand are held in fixed relation by a yoke body 34 in cooperation with the top and bottom roller assembly caps 22*a* and 22*b*. In the construction of a preferred embodiment of the roller assembly 18 (and similarly for roller assembly 20), the spring pin 21 is inserted into each roller 18*a*, 18*b* (20*a* and 20*b*). The yoke body 34 is placed adjacent the rollers 18*a*, 18*b* (20*a*, 20*b*) and roller assembly caps 22*a*, 22*b* are placed in axial alignment with the rollers. Fastener means, such as a screw or small bolt 38, is fastened at the outer surface of roller assembly caps 22*a*, 22*b*, preferably at the center of the assembly caps to fasten the roller assemblies 18, 20 together.

As shown in FIG. 2, the C-shaped housing 16 includes two main parts, namely, a top or upper case housing 39*a* and bottom or lower case housing 39*b*. It will be understood that in the assembly of baton holder 12, the roller assemblies 18, 20 can be inserted into top case housing 39*a* and bottom case housing 39*b* then secured thereto to lock roller assemblies within the C-shaped housing 16. A boss 90 located in each roller assembly cap 22*a* and 22*b*, and dimensioned to receive the fastening screw 38, is received between corresponding recesses 92 in the top case housing 39*a* and bottom case housing 39*b*. Thus, when the top case housing 39*a* and bottom case housing 39*b* are mated together, the roller assemblies 18, 20 are retained therebetween and are able to pivot about the axis of the bosses 90. More specifically, each roller assembly 18 and 20 pivots about the bosses 90 as a fixed unit, meaning that the forward and rear rollers 18*a*, 18*b* (20*a*, 20*b*) pivot as a unit, as the entire roller assembly 18 (20) pivots. This facilitates the snap-action insertion and release of the baton 24, as will be described hereinafter. It will be understood that other types of roller units, acting in a similar fashion to those shown, may be used without departing from the novel scope of the present invention.

In the assembly of housing 16, however, it will be noted that a spring insert 40 and the friction pad 23 are first inserted into their respective location in housing 16. As noted above, friction pad 23 can be inserted against interior connecting wall 16*c* and held in a desirable location for contact with baton 24. The spring insert 40 can be inserted into a recess 40*a* of the bottom case housing 39*b*, as well as into a cooperating recess in the top case housing 39*a*. Because the spring insert is received within corresponding recesses 40*a* in both the top and bottom case housings 39*a*, 39*b*, the case housings are brought into alignment with each other. The top case housing 39*a* and bottom case housing 39*b* can then be held together with one or more fasteners 41, such as the cooperating male and/or female elongated screws or bolts, as shown.

The spring insert 40 in the present embodiment may provide the bias that allows roller assemblies 18, 20 to act as snap-action retaining members. Also, because the scabbard 10 is made of material that has some degree of flexibility (e.g., a plastic material, as opposed to rigid solid metal), such material in conjunction with the spring insert 40 permits the "arms" 16*a* of the C-shaped housing 16 to reciprocally flex in the direction shown by reference arrow 94 (FIG. 3).

Referring now to FIG. 2 and FIGS. 5–9, the housing 16 includes the top case housing 39*a* and the bottom case housing 39*b*. FIG. 5 shows a rear perspective view of the bottom case housing 39*b*, FIG. 6 shows a rear view of the bottom case housing 39*b*, FIG. 7 shows a side view of FIG. 6, FIG. 8 shows a rear view of the top case housing 39*a*, and FIG. 9 shows a side view of FIG. 8. These views are shown with the belt attachment clip assembly 14 (FIG. 2) removed to particularly illustrate a generally wheel shaped molding 42 located opposite the receiving entry opening 17 of the housing 16. The wheel shaped molding 42 includes a circular member 44 having a generally smaller, but raised concentric cylindrical hub 46 within the circular member 44. Note that in FIG. 2, only an outer edge 43 of the wheel shaped molding 42 can be seen. The circular member 44 and hub 46 are not visible in that view.

Referring now to FIGS. 8 and 9, the rear of the top case housing 39*a* is shown. A molded semicircular recess 47 cooperates with the circular member 44 of the bottom case housing 39*b* of FIGS. 6 and 7 when the top case housing and bottom case housing are assembled. This provides a backing or support for the "top half" of the circular member 44. As shown in FIGS. 6 and 7, the circular member 44 projects upward from a generally horizontal plane 47*a* (FIGS. 6 and 7) of the bottom case housing 39*b* such that approximately one-half of the circular member 44 is shown above the horizontal plane.

Figure 10:
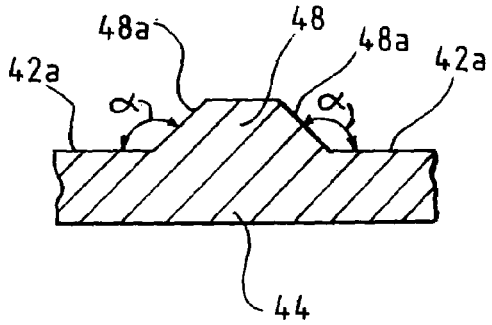
FIG. 10 is a fragmentary cross-sectional view of the wheel shaped molding of the lower case housing showing raised radii taken along the line 10—10 of FIG. 6, which radii cooperate with the detents of the belt clip shown in FIG. 13 to enable selective pivotal adjustment of the scabbard housing relative to the belt clip.
Figure 11:
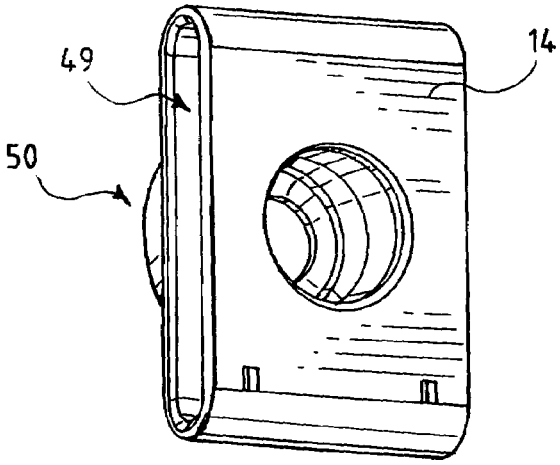
FIG. 11 is a perspective view of a belt clip assembly.
Figure 12:
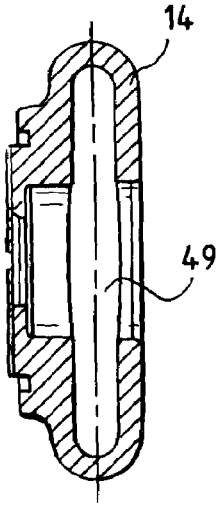
FIG. 12 is a sectional view of the belt clip assembly of FIG. 11.

Referring now to FIGS. 5, 6, 10 in the illustrative embodiment, the circular member 44 and the hub 46 may be integrally molded so as to include a plurality of raised radii 48, which are elevated relative to the plane of the wheel shaped molding 42. The raised radii 48 project outwardly from the perimeter of the hub 46 toward the outer perimeter of the circular member 44. As shown in cross-section in FIG. 10, the raised radii 48 have a trapezoidal cross-sectional shape. In a preferred embodiment, radii walls 48*a* form an angle, $\alpha$, with the plane of the circular member 44 in a range greater than 90 degrees and less than or equal to 135 degrees. It will be understood, by persons having skill in the art that the baton holder of the present invention can be manufactured without the wheel shaped molding and concomitant structures without departing from the novel aspects of the present invention. Further, it will be understood by persons having skill in the art that radii 48 can be formed in different cross-sectional shapes and/or having different angular configurations without departing from the novel scope of the present invention.

Figure 13:
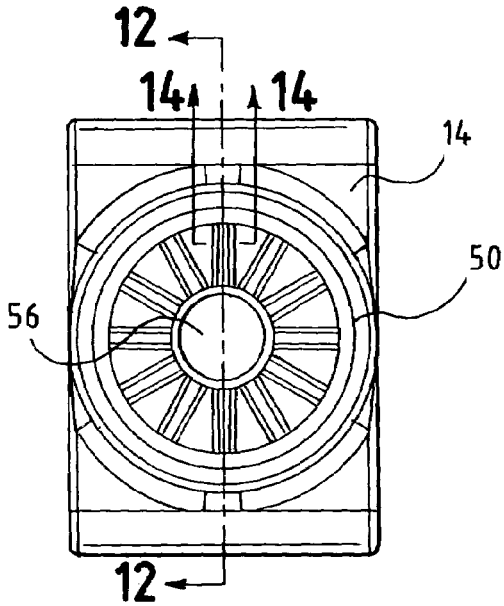
FIG. 13 is a rear elevational view of the belt clip assembly of FIG. 11 particularly illustrating the detents that cooperate with the raised radii of FIG. 10.

Referring now to FIGS. 2, 5, 6, and 11–14, FIGS. 11 and 12 illustrate the belt clip 14 having a hollow channel 49 through which a belt may pass so as to secure the belt clip, and hence the baton holder 12, to the user's belt. As shown in FIG. 13, the rear side of the belt clip 14 is shown to particularly point out a complimentary locking wheel 50. The locking wheel 50 includes a circular aperture 56. The aperture 56 is configured to cooperate with and accept the corresponding cylindrical hub 46 so as to form a locking engagement that permits the belt clip 14 to be secured to and rotate relative to the bottom case housing 39*b*. It will be understood by persons having skill in the art that any manner of locking ring, such as a "radially inwardly tabbed" locking ring may be placed or attached so as to lock the belt attachment 14 and bottom case housing 39*b* together after hub 46 is inserted into the aperture 56.

Figure 14:
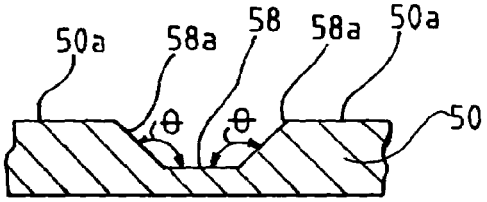
FIG. 14 is a fragmentary cross-sectional view showing raised radii taken along the line 14—14 of FIG. 13, which radii cooperate with the detents of the wheel shaped housing of FIG. 6 to enable selective pivotal adjustment of the scabbard housing relative to the belt clip.

Similar to the raised radii 48 for the circular member 44 of FIG. 6, the locking wheel 50 and circular aperture of FIG. 13 are connected together by complementary recessed radii 58, shown in greater detail in FIG. 14. The recessed radii 58 are recessed into the plane of the surface of the locking wheel 52. As shown in FIG. 14, the recessed radii 58 have a trapezoidal cross-sectional shape, which is complimentary to the raised radii 48 of FIG. 10. In a preferred embodiment, recessed walls 58*a* form an angle, θ, with the locking wheel walls in a range of between greater than 90 degrees and less than or equal to 135 degrees. It will be understood by persons having skill in the art that the belt attachment of the present invention can be manufactured without the wheel shaped molding and concomitant structures without departing from the novel scope of the present invention. Further, it will be understood by persons having skill in the art that recessed radii 58 can be formed in different cross-sectional shapes and/or having different angular configurations without departing from the novel scope of the present invention.

The connection of baton holder 12 and belt attachment 14 together, in the manner described above, permits the intermeshing of raised radii 48 and recessed radii 58 when the circular member 44 is assembled with the locking wheel 50. This permits the baton holder 12 can be rotated to a desirable integral angle relative to belt attachment 14. The number of integral angular "stops" is governed by the number of radii 48 and 58 distributed about the circular member 44 and locking wheel 50, respectively, and the angular spacing therebetween. The preferred shapes of raised radii 48 and the recessed radii 58 permit interlocking of circular member 44 and the locking wheel 50 such that a desired amount of rotational force or pressure causes the circular member 44 to rotate relative to the locking wheel 50 (which is preferably fixed in position via the user's belt that extends through the belt clip 14). The force sufficient to cause rotation of the circular member 44 relative to the locking wheel 50, and hence rotation of the baton holder 12, necessarily forces the circular member slightly apart from the locking wheel 50 along an axial axis 59 (FIG. 5) to permit the raised radii 48 to pass over and across the recessed radii 58 in a "detent" or "click-stop" manner. As mentioned above, the circular member 44 is locked to the locking wheel 50 with a locking ring (not shown) that permits the circular member 44 to slightly separate relative to the locking wheel 50 when sufficient rotational force is applied. Greater detail regarding the detent mechanism described above is disclosed in U.S. Pat. No. 6,889,878 assigned to the assignee of the present invention, and which is incorporated by reference in its entirety herein.

Referring back to FIG. 2, various bars or inserts 60 are shown that can be inserted within the belt opening 49 of the belt attachment 14 to permit the use of a wide variety of belt sizes with the device of the present invention. It will be understood by persons having skill in the art that various means of permitting the use of different size and thickness belts can be employed without departing from the novel scope of the present invention.

Figure 15:
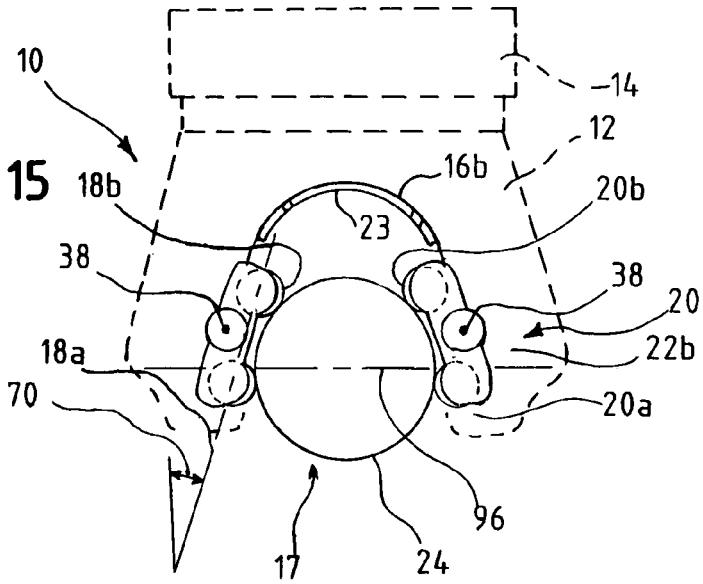
FIG. 15 is a schematic plan view particularly showing the angular position
Figure 16:
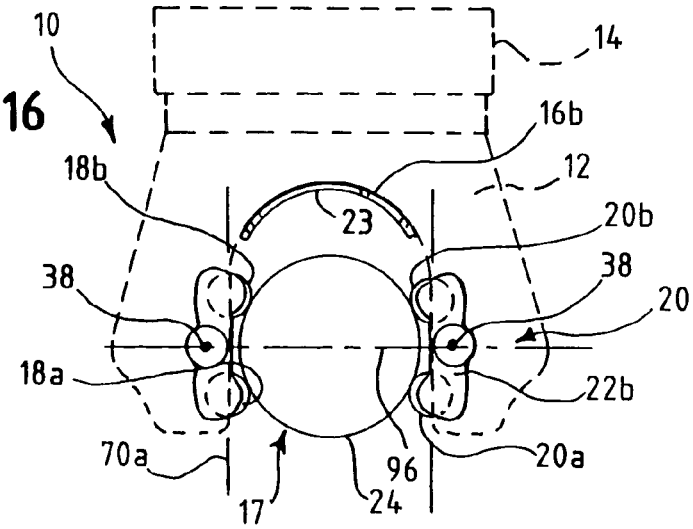
FIG. 16 is a schematic plan view particularly showing the angular position of the rollers when a baton is partially inserted into the baton holder.
Figure 17:
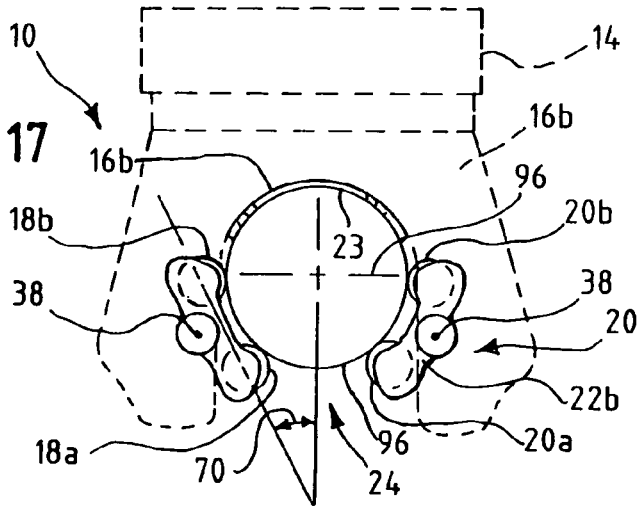
FIG. 17 is a schematic plan view particularly showing the angular position of the rollers when a baton is fully inserted into the baton holder.

Referring now to FIGS. 15–17, FIG. 15 shows the "pivoting" position of the forward and rearward rollers 18*a*, 18*b* (20*a*, 20*b*) in the roller assembly 18 (20) as a baton 24 is initially inserted. FIG. 16 shows the "pivoting" position of the forward and rearward rollers 18*a*, 18*b* (20*a*, 20*b*) in the roller assembly 18 (20) as the baton 24 is partially inserted. FIG. 17 shows the "pivoting" position of the forward and rearward rollers 18*a*, 18*b* (20*a*, 20*b*) in the roller assembly 18 (20) when the baton 24 is fully inserted into the scabbard 10. Note that the angles and distances with respect to the rollers are not necessarily drawn to scale, and are for purposes of illustration only.

In the operation of the scabbard 10, an officer brings his or her baton 24 to the generally C-shaped recess opening 17 of the scabbard 10 and pushes it laterally into the opening. Initially, the leading edges of the forward rollers 18*a*, 20*a* of the roller assemblies 18, 20 contacts the circumference of the baton, as shown in FIG. 15. This tends to cause each roller assembly 18, 20 to pivot outwardly about an axis 66 (FIG. 2) of the roller assembly, which is coaxial with the fastener 38. This angle is shown by reference numeral 70 (FIG. 15). As illustrated, the angle 70 formed by the roller assemblies 18, 20 appears to "diverge" outwardly from the opening. In this position, the rear rollers 18*b*, 20*b* are "behind" a centerline diameter 96 of the baton 24 while the forward rollers 18*a*, 20*a* are slightly in front of the centerline diameter of the baton.

Next, as the baton is further inserted into the opening 17, the roller assemblies 18, 20 further pivot until both the forward rollers 18*a*, 20*a* and rear rollers 18*b*, 20*b* contact the baton 24 and are approximately equidistant from the centerline diameter 96 of the baton 24, as shown in FIG. 16. Accordingly, the angle 70*a* formed by the axis lines of each roller assembly is essentially parallel, as seen in FIG. 16. This causes the arms of the C-shaped housing 16 to flex outwardly in order to accommodate the baton, causing tension tending to "compress" the baton covering. Such outward flexing of the C-shaped housing is counter-biased by the spring tension provided by the spring insert (FIG. 2).

As the baton 24 is urged further back, the baton 24 eventually engages friction pad 23, or if not installed, the interior wall 16*b* of the housing. Note that the friction pad 23 may assist in holding the baton 24 in a vertical position relative to the baton holder 12 without slipping downward. Further, the material from which the rollers are formed may also assist in gripping the baton.

In this fully engaged position, the roller assemblies 18, 20 pivot the opposite way about their pivotal axes 66 (FIG. 2) to "snap" back into position under the tension caused by the spring insert 40 (FIG. 2) and the flexing of the housing, so that the forward rollers 18*a*, 20*a* and the rear rollers 18*b*, 20*b* of both roller assemblies tangentially contact the baton 24. The forward rollers essentially "snap" back into an over-center position and urge the baton 24 against the friction pad 23 or back wall 16*b* of the housing 16. In this position, as illustrated in FIG. 17, an angle 72 formed by the roller assemblies 18, 20 appears to "converge" outwardly from the opening. Moreover, in this position, the forward rollers 18*a*, 20*a* are "in front of" the centerline diameter 96 of the baton 24 and tend to urge the baton 24 against the friction pad or back wall which thus serve at a stop surface for engagement by the baton when fully inserted into the C-shaped recess in the baton holder housing 16.

Although an illustrative embodiment of the invention has been shown and described, it is to be understood that various modifications and substitutions may be made by those skilled in the art without departing from the novel spirit and scope of the invention.

What is claimed is:

1. A scabbard comprising:

a carrier having a generally C-shaped cross section, a rear wall and top and bottom, the top and bottom being open such that different length batons can be placed therein;

an over-center latching mechanism within the carrier, comprising two sets of roller assemblies, each roller assembly having a front roller and a rear roller pivoted together about a pivotal axis such that as a baton is inserted into the scabbard, the two front rollers pivot apart, and as the baton is pushed further against the rear rollers, the baton is snapped into the scabbard and the front rollers are pivoted together to hold the baton in place;

the over-center latching mechanism being self-adjustable such that different diameter pole-shaped devices can be placed within the scabbard; and said carrier including a friction member releasably attached to the rear wall such that when a baton is placed into the scabbard the friction member and baton are in touching relation.

2. The scabbard as defined in claim 1 wherein the carrier includes upper and lower generally C-shaped housing portions supporting said rollers and having laterally opposed ends defining said entry opening to permit a baton of a predetermined diameter range to be inserted laterally into said entry opening.

3. The scabbard of claim 2 wherein said upper and lower frame portions are disposed in parallel spaced relation, said sets of rollers being supported by and between said frame portions.

4. A scabbard as defined in claim 3 including a generally C-shaped arcuate spring supported by the carrier so as bias the laterally opposed ends of the upper and lower frame portions toward each other in a manner to urge the latching mechanism means into latching relation with a baton inserted laterally into the recess.

5. The scabbard of claim 1 wherein as the baton is inserted into the carrier and contacts the rear rollers, the roller assemblies snap into place against the baton such that the front and rear rollers encompass a portion of the baton and urge the baton against the friction member.

6. The scabbard of claim 1, wherein the friction member is constructed of a smooth rubber.

7. A scabbard as defined in claim 1 wherein said rollers have crowned peripheral surfaces.

8. A scabbard as defined in claim 1 including spring means operatively associated with said carrier for biasing the over-center latching mechanism into latched relation with the baton.

9. A scabbard as defined in claim 1 including belt attachment means for releasably supporting the scabbard adjacent a user's waist.

10. A scabbard as defined in claim 9 wherein said belt attachment means includes a wheel shaped molding supported on said carrier, and a belt clip member mutually cooperable with said wheel shaped molding and defining a belt receiving channel.

11. A scabbard as defined in claim 10 wherein said belt clip member includes a locking wheel mutually cooperable with said wheel shaped molding to enable selective rotation of said belt clip member relative to said carrier so as to allow variable angular orientation of a baton supported by the scabbard adjacent the wearer's waist.

* * * * *